US006087792A

United States Patent [19]

Wang

[11] Patent Number: 6,087,792

[45] Date of Patent: Jul. 11, 2000

[54] CONTROL CIRCUIT FOR MOTOR OF ELECTRIC JOGGING DEVICE

[76] Inventor: Leao Wang, No 1, Lane 154, Charng Long Rd., Taiping City, Taichung Hsien, Taiwan

[21] Appl. No.: 09/295,501

[22] Filed: Apr. 21, 1999

[51] Int. Cl.[7] ..... A63B 22/02; H02P 3/00

[52] U.S. Cl. ..... 318/362; 318/558; 388/903; 482/54

[58] Field of Search ..... 318/362, 364, 318/445, 558, 563; 388/903; 482/4, 5, 6, 7, 54

[56] References Cited

U.S. PATENT DOCUMENTS

| | | | |
|---|---|---|---|
| 3,711,812 | 1/1973 | Cherry . | |
| 4,364,556 | 12/1982 | Otte | 272/69 |
| 4,426,075 | 1/1984 | Otte | 272/69 |
| 4,643,418 | 2/1987 | Bart . | |
| 4,898,378 | 2/1990 | Edwards et al. | 272/69 |
| 5,034,576 | 7/1991 | Dalebout et al. | 200/43.04 |
| 5,368,532 | 11/1994 | Farnet | 482/5 |
| 5,476,430 | 12/1995 | Lee et al. | 482/54 |
| 5,571,062 | 11/1996 | Saganovsky | 482/54 |
| 5,944,635 | 8/1999 | Butler, Jr. | 482/54 |

*Primary Examiner*—Bentsu Ro

[57] ABSTRACT

The present invention relates to a control circuit for motor of electric jogging device in which a safety switch is disposed between an electronic loop and a power switch and which has an inserted safety plug-in pin to connect the power in an ON state. Accordingly, when the safety plug-in is removed from the fastening position, the second safety switch will be shut down in an OFF state so that the power won't enter into the electronic loop again and the motor won't be driven, and the safety of the user can be ensured.

2 Claims, 7 Drawing Sheets

CONTROL CIRCUIT FOR MOTOR OF ELECTRIC JOGGING DEVICE

BACKGROUND OF THE INVENTION

1. Field of the Invention

The present invention relates to a control circuit for motor of electric jogging device, and more particularly to a control circuit to ensure the user's safety.

2. Description of the Prior Art

The conventional electric jogging device is designed as FIG. 1 shows. It mainly includes a unit body 10 whose basis is fitted with a motor and a transmission mechanism (not shown) in order for a motor control circuit inside of an electronic gauge panel 12 to drive the motor and the transmission mechanism in rotation when the power switch 11 is turned on, whereby the runway band 13 starts the cyclic rotation. Accordingly, the user is able to stand thereon to make a jogging exercise.

The basic control circuit for conventional motors is shown in FIG. 2. It mainly includes a power switch 21 between a power input terminal 20 and an electronic loop 22. The other side of the electronic loop 22 has a safety system loop 23 with a safety plug-in pin 24. Besides, the electronic loop 22 is connected with a control panel 25 so as to control the operation of the motor 26.

Referring to FIGS. 1 and 2, the safety plug-in pin 24 of the above-mentioned safety system loop 23 is, in fact, a power sensing wire 15 with a plug-in terminal 14 and is plugged in the plug-in hole 16 of the safety system loop 23 of the electronic gauge panel 12 and appears outside of the unit body 10. The other end is a clamp 17 to clamp on the body of the user. Therefore, when the user wishes to use this unit 10, the plug-in terminal 14 of the safety plug-in 24 has to be inserted into the plug-in hole 16 so that the electronic loop 22 will normally supply power to the control panel 25 and the motor 26 for performing the pre-arranged circuit control procedure. In another words, when the plug-in terminal 14 of the safety plug-in pin 24 separates from the plug-in hole 16 due to slipping or another accidents of the user, the safety system loop 23 will send this message to the electronic loop 22 to order the control panel 25 to stop to supply power to the motor 26. Accordingly, the runway band 13 won't run around any more.

Although the expected effect is able to be reached with this conventional safety control method, it still has disadvantages. When the safety plug-in pin 24 separates from the plug-in hole 16, the power input terminal 20 still supplies power to the electronic loop 22 (because the power switch 21 is till in ON-state). In short, if a malfunction happens to the safety system loop 23, this message can't exactly be sent to the electronic loop 22. Therefore, the control panel 25 and the motor 26 continue to be in operation to result in a high danger.

A number of reasons accounts for the malfunction of the safety system loop 23, e.g. the electronic parts are wet, burnt down or its use is beyond the expiry date.

SUMMARY OF THE INVENTION

It is a main object of the present invention to provide a safety system for a control circuit for a motor of an electric jogging device which can greatly ensure the safety of the user during a malfunction of local electronic parts.

BRIEF DESCRIPTION OF THE DRAWINGS

The drawings disclose illustrative an embodiment of the present invention which serves to exemplify the various advantages and objects hereof, and are as follows.

DETAILED DESCRIPTION OF THE PREFERRED EMBODIMENT

Figure 1:
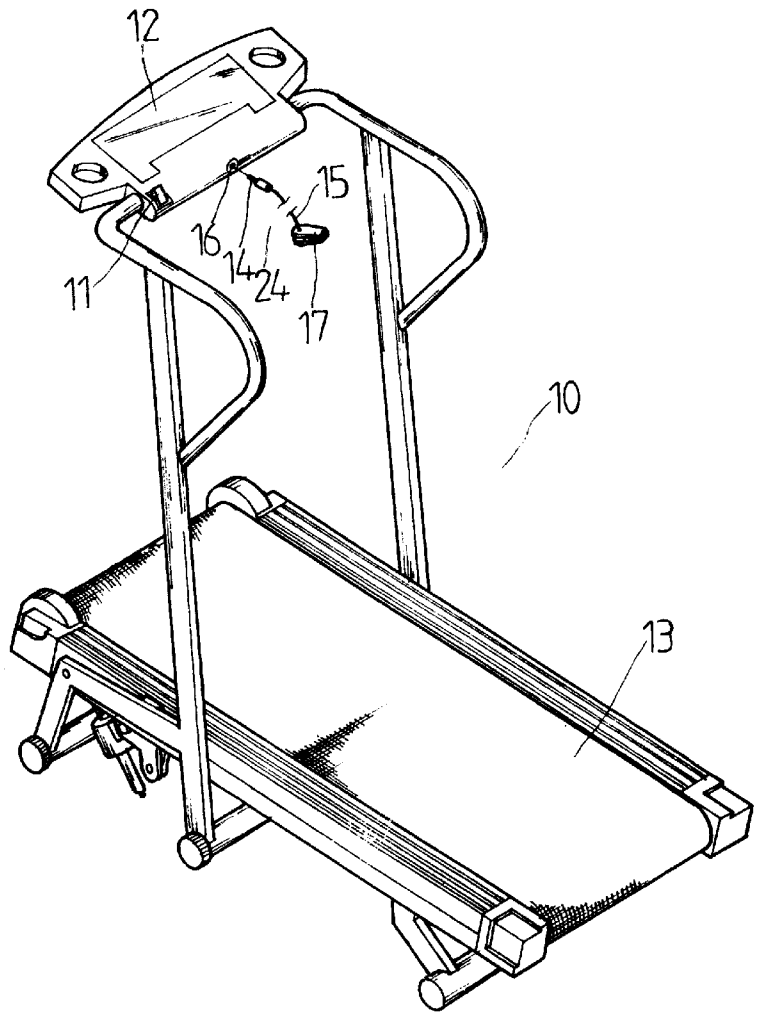
FIG. 1 PRIOR ART
FIG. 1 is a perspective view of an electric jogging device.
Figure 2:
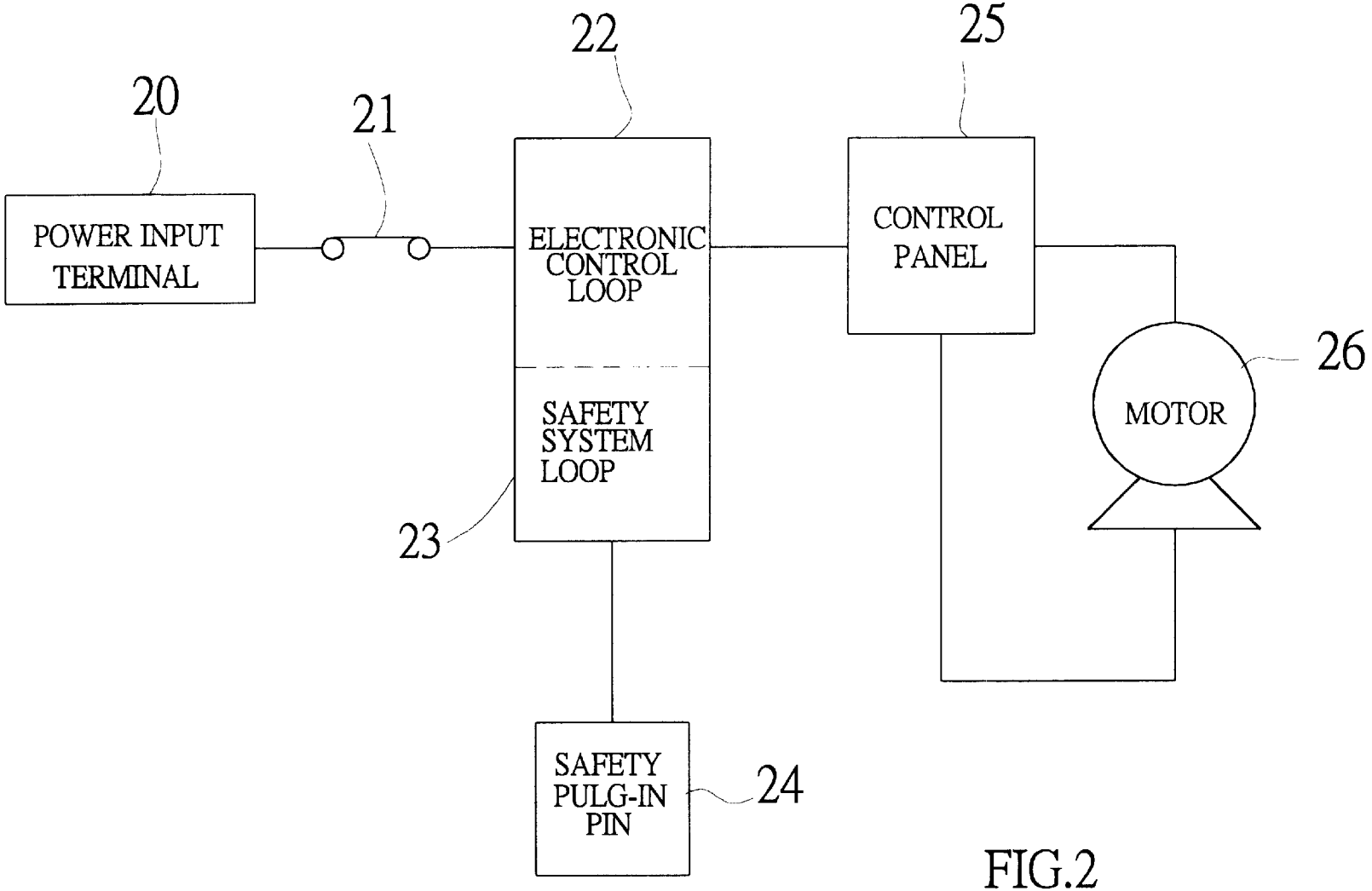
FIG.2 PRIOR ART
FIG. 2 is a schematic drawing of the control circuit for motor of a conventional electric jogging device.
Figure 3:
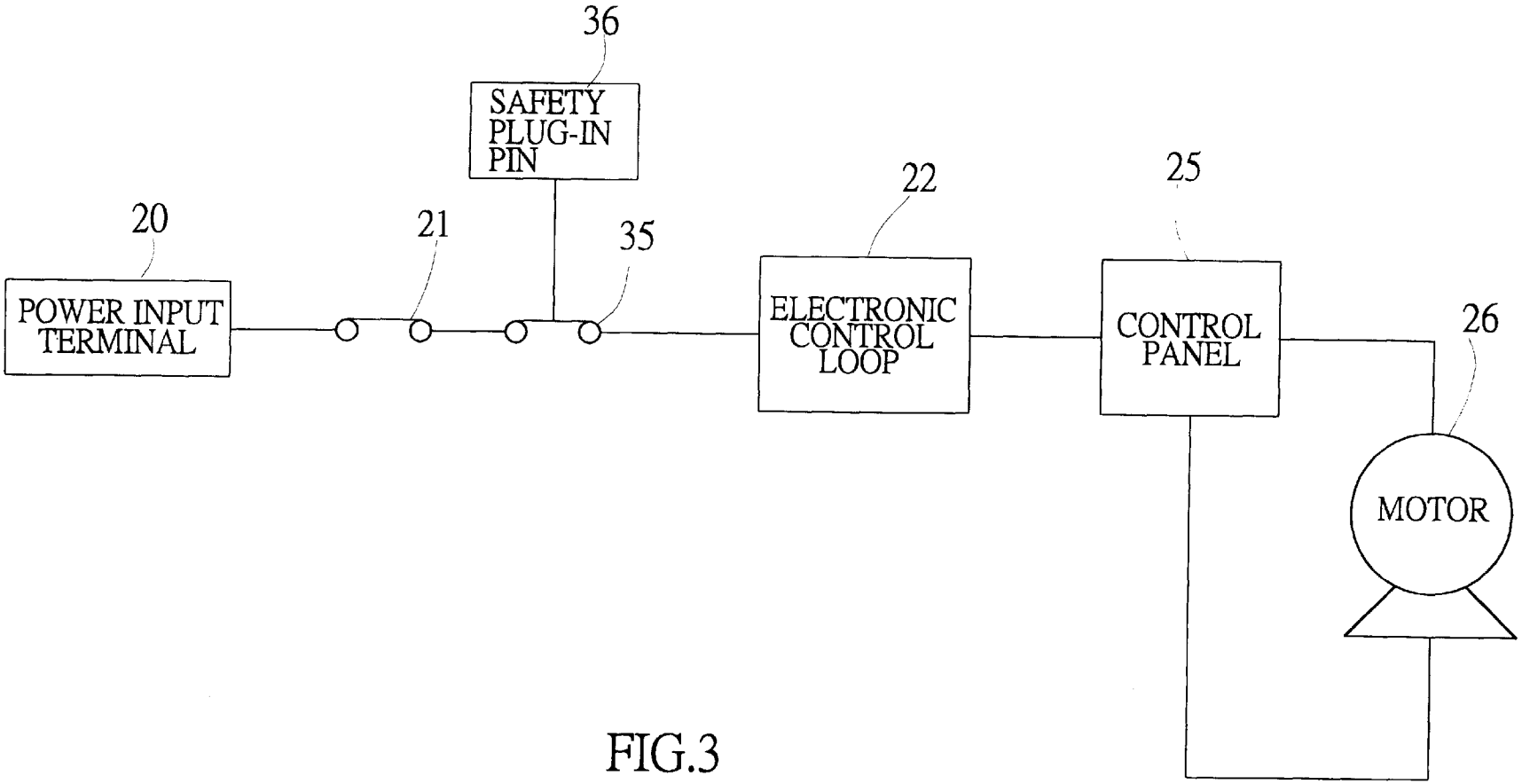
FIG. 3 is a schematic drawing of a preferred embodiment of the motor control circuit in accordance with the present invention.
Figure 4:
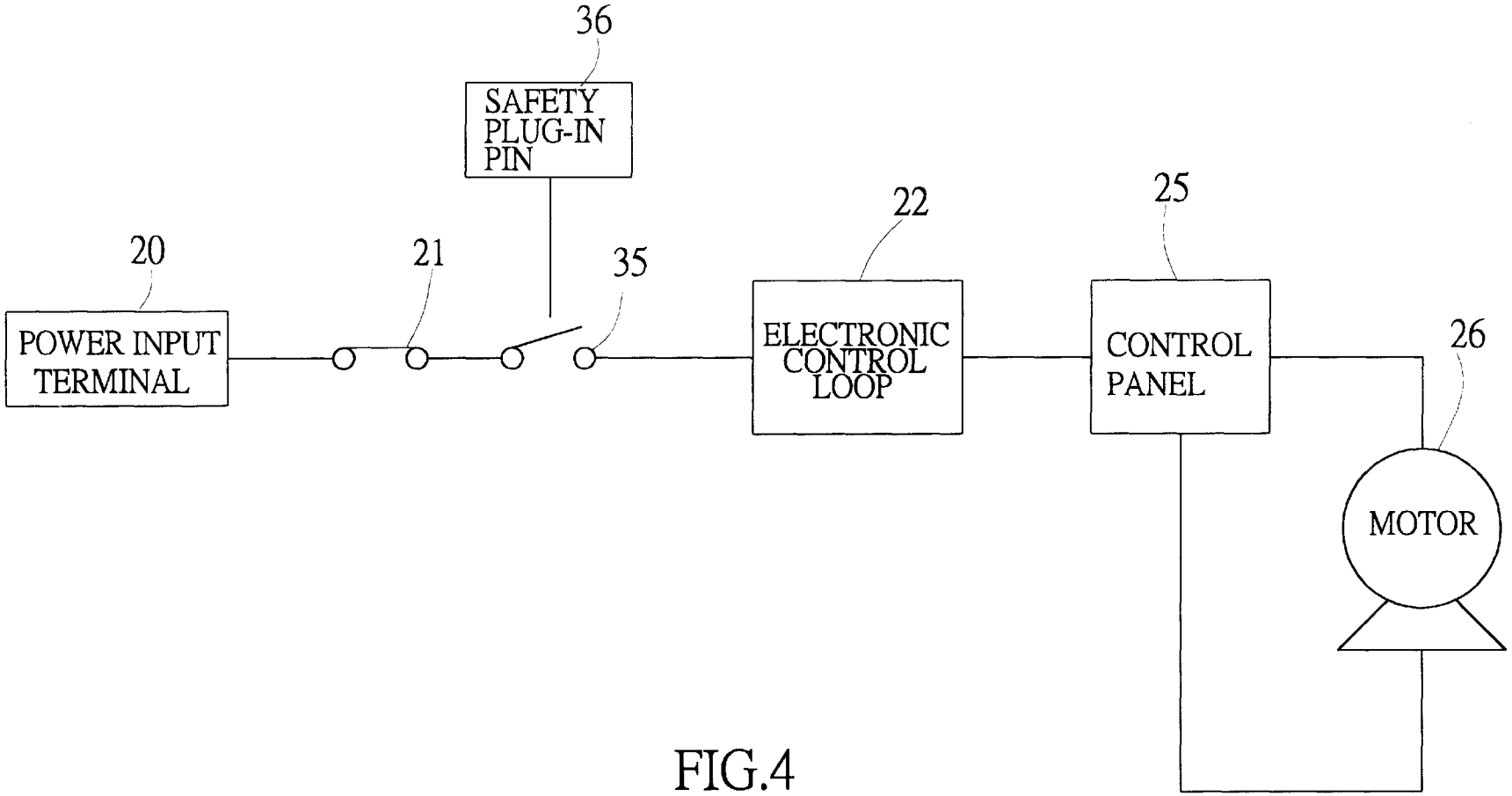
FIG. 4 is a schematic drawing in accordance with FIG. 3, when the safety plug-in pin separates from the second safety switch.

First of all, referring to FIG. 3, it shows a preferred embodiment of the present invention. Therefrom, the motor control circuit includes the power input terminal 20, the power switch 21, the electronic loop 22, the control panel 25 and the motor 25. A safety switch 35 is disposed between the electronic loop 22 and the power switch 21 and it is activated by a safety plug-in pin 36 to connect the power in an ON state. Accordingly, as shown in FIG. 4, when the safety plug-in pin 36 is removed from the fastening position, the safety switch 35 will be shut down in an OFF state so that the power won't enter into the electronic loop 22 again and the motor 26 won't be driven.

Figure 5:
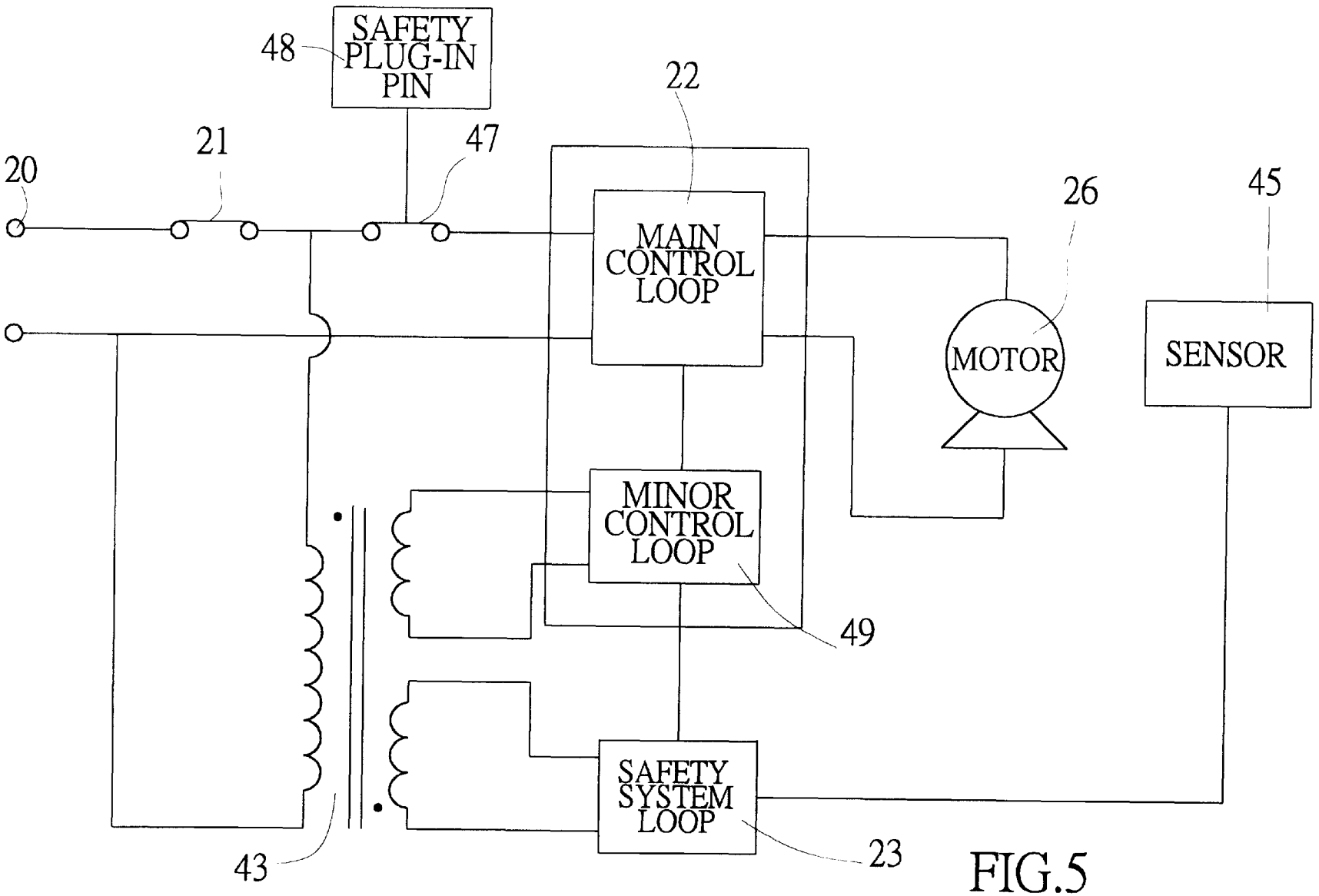
FIG. 5 is a schematic drawing of another preferred embodiment of the motor control circuit in accordance with the present invention.
Figure 6:
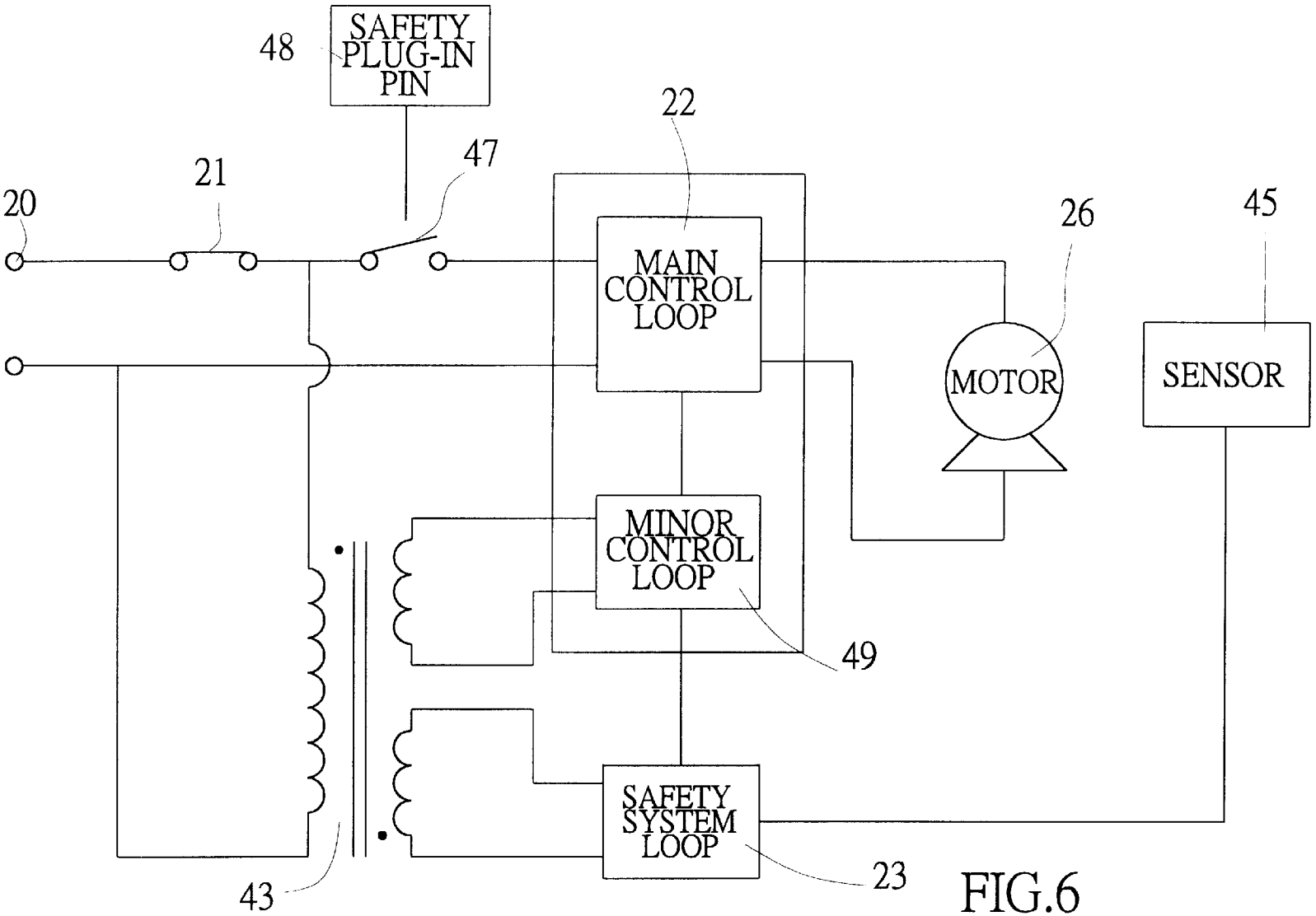
FIG. 6 is a schematic drawing in accordance with FIG. 5, when the safety plug-in separates from the second safety switch.

Please refer to FIG. 5 which shows a preferred embodiment of the present invention. Therefrom, the motor control circuit includes the power input terminal 20, the power switch 21, the main control 22, an isolation transformer 43, the safety system loop 23, a sensor 45 and the motor 26. A safety switch 47 is disposed between the main control loop 22 and the power switch 21 and it is inserted with a safety plug-in pin 48 to connect the power in an ON state. Accordingly, as shown in FIG. 6, when the safety plug-in pin 48 is removed from the fastening position, the safety switch 47 will be shut down in an OFF state so that the power won't enter into the main control loop 22 again, and the motor 26 won't be driven. Moreover, the isolation transformer 43 divides the power to flow into a minor control loop 49 of the main control loop 22 and the safety system loop 23, whereby the safety system loop 23 and the sensor 45 are connected with each other and the sensor 45 is used to detect the operation state of the motor 26. Therefore, when a malfunction (stall or failure to operate) happens to the motor 26, it will be sensed by the sensor 45 and sent to the safety system loop 23 by which this message will be transmitted to the minor control loop 49 so that the main control loop 22 will be ordered to stop the supply of power to the motor 26. Accordingly, a second safety protection is formed.

Figure 7:
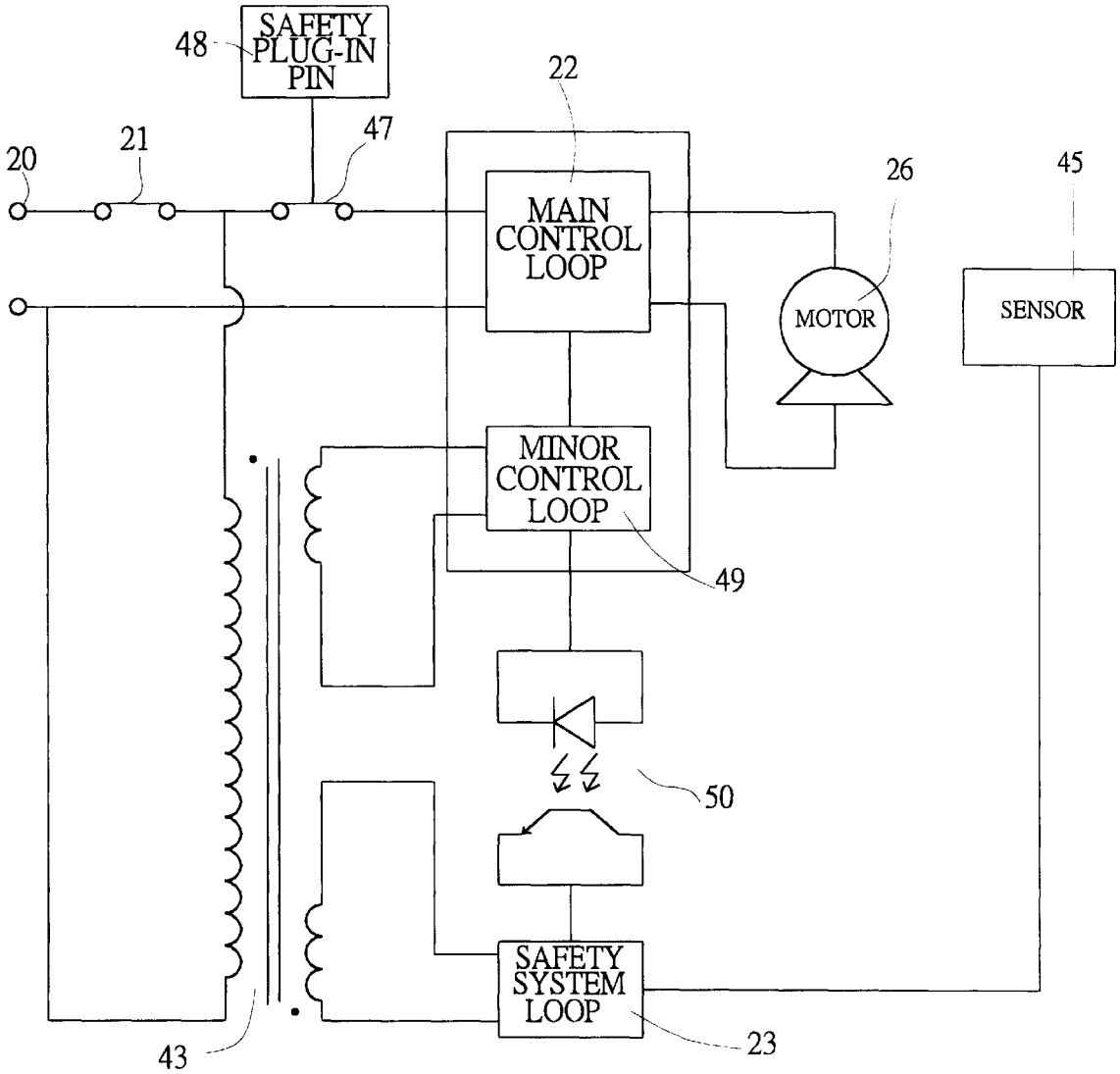
FIG. 7 is a schematic drawing of a further preferred embodiment of the motor control circuit in accordance with the present invention.

As shown in FIG. 7, a light-sensitive transmitter 50 is disposed between the minor control loop 49 of the main control loop 22 and the safety system loop 23 so that the sensed message about the malfunction of the motor 26 will be sent by the light-sensitive transmitter 50 to the main control loop 22.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A safety system for a control circuit of a motor of an electric jogging device, the control circuit having a power input terminal connected to a main control loop, a power on-off switch interposed between the power input terminal and the main control loop, a minor control loop connected to the main control loop, a safety system loop connected to the minor control loop and a motor connected to the main control loop, the safety system comprising:

a) a safety switch interposed between the power on-off switch and the main control loop, the safety switch actuated between on and off positions by a safety plug-in pin whereby the safety switch is in the on position when engaged by safety plug-in pin and is in the off position when the safety plug-in pin is disengaged, thereby shutting off electrical power to the main control loop;

b) an isolation transformer connected to the power input terminal, and having a first portion connected to the minor control loop and a second portion connected to the safety system loop; and, c) a sensor connected to the safety system loop which detects the operative state of the motor such that an operative malfunction of the motor is sensed by the sensor which signals the safety system loop to stop the supply of power to the motor via the main control loop.

2. The safety system of claim 1 wherein the safety system loop is connected to the minor control loop by a light sensitive transmitter.

* * * * *